US005933973A

United States Patent [19]

Fenley, Jr.

[11] Patent Number: 5,933,973

[45] Date of Patent: Aug. 10, 1999

[54] METHOD AND APPARATUS FOR ASSISTING IN HANGING FRAMED PICTURES AND ACHIEVING PROPER ALIGNMENT

[76] Inventor: Bonnie C. Fenley, Jr., 19002 Casper Dr., Spring, Tex. 77373

[21] Appl. No.: 08/938,338

[22] Filed: Sep. 26, 1997

[51] Int. Cl.[6] ..... G01B 5/14; G01B 3/04

[52] U.S. Cl. ..... 33/451; 33/613; 33/644

[58] Field of Search ..... 33/451, 528, 533, 33/613, 645, 644

[56] References Cited

U.S. PATENT DOCUMENTS

| | | | |
|---|---|---|---|
| 1,740,597 | 12/1929 | Hoyer | 33/451 |
| 1,772,925 | 8/1930 | Wernicke | 33/451 |
| 2,816,366 | 12/1957 | Barlow | 33/644 |
| 3,371,423 | 3/1968 | Paul | 33/613 |
| 4,241,510 | 12/1980 | Radecki | 33/613 |
| 4,443,949 | 4/1984 | Newton | 33/613 |
| 5,131,164 | 7/1992 | Miller | 33/613 |

*Primary Examiner*—Christopher W. Fulton
*Attorney, Agent, or Firm*—Gunn & Associates, P.C.

[57] ABSTRACT

This disclosure is directed to a elongate ruler having a row of calibration marks thereon, preferably a second row reading from the opposite end, and a set of nail holes at spaced distances therein. The nail holes are either on the centerline or along one edge of the ruler. The ruler extends through a housing engaging the housing at a slot through the housing. There is an alignment surface in the housing to assure alignment of the housing with respect to the ruler. The housing supports a first bubble level responsive to the horizontal, and a second bubble level at right angles to enable the ruler and housing to be positioned vertically. The housing and ruler enable ruler movement while making measurements along the wall.

17 Claims, 1 Drawing Sheet

FIG. 1
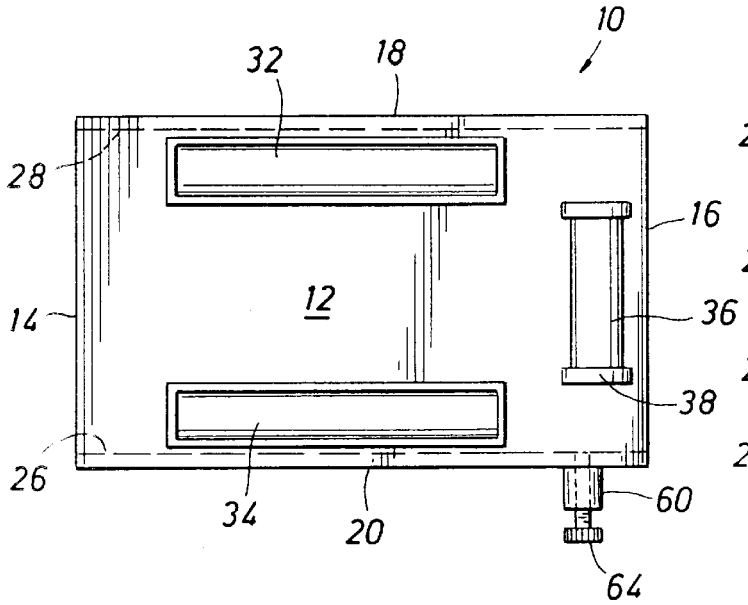
FIG. 2
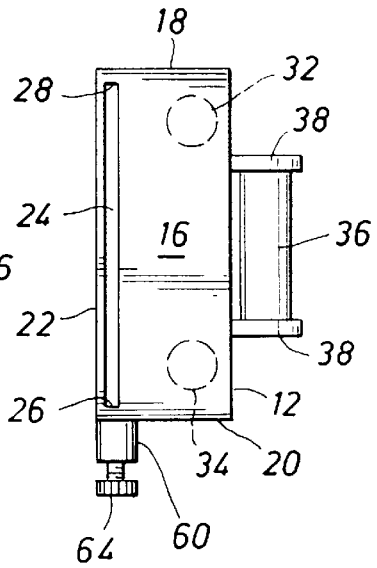
FIG. 3
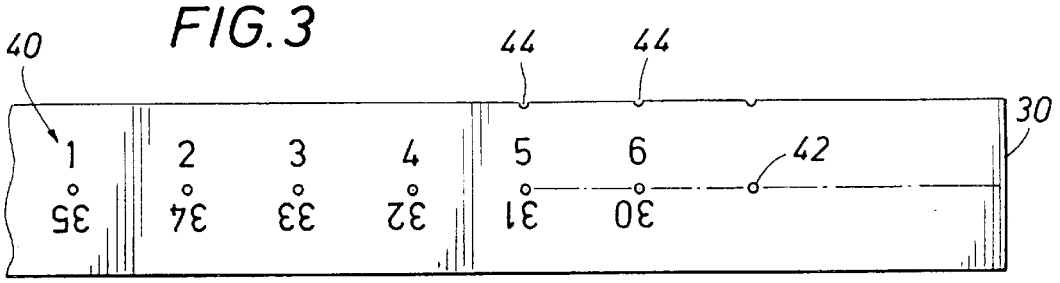
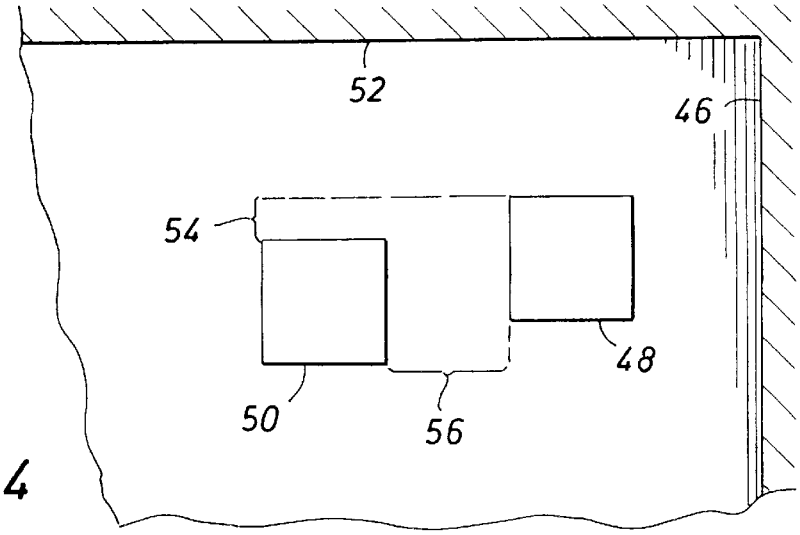
FIG. 4

METHOD AND APPARATUS FOR ASSISTING IN HANGING FRAMED PICTURES AND ACHIEVING PROPER ALIGNMENT

BACKGROUND OF THE DISCLOSURE

The present disclosure is directed to an apparatus which assists in hanging and achieving alignment among several items. Consider a challenge to a decorator of hanging four framed items of identical size on a common wall. Assume for purposes of discussion that they should be hung in two rows of two. It could just as easily be a single row of four items evenly spaced. While attractive to the eye, it is difficult to achieve with the accuracy so that visual observation, even by indifferent observers, may show that the hanged items are somehow out of order. To get the items in order, it is necessary to hang them precisely. This chore can be tedious because it is very difficult to achieve using a simple yardstick or tape measure. With a tape measure, the location of one item can be determined with respect to a corner wall and the ceiling line. The first item is typically hung and the second item is then referenced to the first. This requires measurements to be taken, placing a nail in the wall (or perhaps a mounting bracket for framed items), and the added framed items are then referenced to the first. Even when the measurements are taken with some care and precision, the group of four identical framed items may not really have the look desired; that can be visually detected even with the variance of only about ⅛th of an inch. Even worse, measurements made by the decorator when standing right next to the framed items can seem right, but when that person steps away from the wall, even angular misalignments of a modest amount can be seen. Even worse, misalignments are often encountered because the references used in the measurements (typically the corner intersection with an adjacent wall) are off. Accordingly, the present apparatus and the method disclosed herein enable more accurate hanging so that the desired appearance is achieved.

When hanging framed items, a reference is established normally using one corner of the room. When that is the reference, the installer will not normally go to any effort to determine if the corner intersection of the two walls is vertical. Most often, it is not. If a first row is hung and then a second row either above or below, they may both be located precisely a measured distance from the corner intersection but still not be vertically aligned. That error can be visually observed in many instances. The equipment of the present disclosure enables precise hanging, and especially enables floating references to be used. For instance, a single framed item can simply be placed on the wall and other framed items are hung in relation to the first. That approach is highly successful with this apparatus. Even to the most careful observer thereafter, the appearance is more ordered and not susceptible so readily to angular misalignment and the like. Careful measurements enabled by the present apparatus are successfully implemented. Alignment from one to the next to the next to the next is achieved. Careful positioning continues around the room should that be desired. The overall appearance and speed of installation is notable. It is especially useful in that the conclusion of the matter is placing a nail in the wall. The present apparatus especially enables quick and easy nailing at the desired location. More than simply marking a spot on the wall with a pencil, the present apparatus guides a nail placed in the wall and is preferably even used as an alignment fixture so that the nail is started properly into the wall. Both for the amateur and professional, this can be of notable assistance.

The device of the present disclosure is a bubble level, there being at least two arranged at 90° so that two level dimensions can be determined. In addition, the bubble levels are supported on a housing having an elongate included slot so that a metal ruler can be inserted in the slot. The metal ruler can have any convenient length such as 100 cm or 36" (obviously depending on the units of measure desired). The ruler inserts through the housing and is able to slide in the housing with controllable friction. This is sufficient to hold the ruler so that it doesn't slide too loosely. Moreover, the ruler is provided with nail set holes located in it at spaced locations differing by arbitrary measurements. The housing supports bubble levels at two dimension as noted, thereby enabling the user to level both the housing and the ruler in two different dimensions. A method of use is also set forth.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

FIG. 1 is a plan view of the housing of the device of the present disclosure showing bubble levels in the housing for alignment during use;

FIG. 2 is an end view of the housing shown in FIG. 1 illustrating a slot through which a ruler is inserted and also showing the bubble levels supported by the housing;

FIG. 3 is a plan view of a portion of the ruler; and

FIG. 4 illustrates steps involved in hanging multiple hanged items with respect to the ceiling and corner of the wall, thereby achieving the desired alignment between framed items.

DETAILED DESCRIPTION OF THE PREFERRED EMBODIMENT

Attention is directed to FIG. 1 where the numeral 10 identifies the apparatus of the present disclosure. It is a rectangular plastic housing comprised of a six sided box having a top 12, ends 14 and 16, longer side walls 18 and 20 and a bottom wall 22 parallel to the top 12. This solid rectangular box incorporates a slot 24 which is found at both end walls 14 and 16. The dimensions of the slot will be discussed in detail later. The slot defines an internal edge 26 which abuts the side of a ruler 30 inserted through the slot. The ruler 30 fits snugly against the wall 26, and also contacts a comparable facing edge 28. This confines the ruler on insertion. The slot 22 has a height sufficient to receive the ruler which has a finite thickness. It is not necessary to grasp the ruler on the top and bottom faces tightly, but it is desirable that it be held by the edges 26 and 28. As will be understood, contact this can be at the slot or it can extend full length along the longer dimension of the housing.

FIG. 1 shows liquid levels 32 and 34. They are bubble defined measuring devices which locate a bubble in a clear transparent housing so that the user is able to see the bubble and determine leveling. In a sense, the two bubble levels are a two level system as shown in FIG. 1 to provide a measure of redundancy but there is some value in this. That will be discussed below. A bubble level 36 is provided at right angles to the bubble levels 32 and 34. It is held in place between a pair of caps 38 located at the ends and which protrude as tabs from the housing for mounting purposes. If desired, this dimensioned bubble level can be replicated at two locations on the housing. Moreover, the bubble levels are at right angles so that they operate in an orthogonal relationship. The bubble levels are used in making alignment.

The ruler 30 is a die stamped and calibrated metal ruler of sufficient stiffness. It has a uniform width so that it fits snugly between the facing slot edges 26 and 28. The ruler is marked with a set of reference numbers at 40, it being understood that the reference numbers are conveniently marked from left to right along the top portion and from right to left (and inverted) opposite the upright numbers. Conveniently, along the centerline of the ruler, there are a number of nail starter holes 42. In the alternative, the nail starter holes can be located along the edge so that there are semicircular notches 44 along the respective top edge or bottom edge. The aligned holes 42 are spaced evenly and uniformly at some desired measurement such as one inch. Again with a metric ruler, a different spacing can be used. The holes 42 are sized so that a small diameter finish nail can be inserted. This serves as a starter hole for the nail to assure that it is installed perpendicular to the wall. This aids uniform installation. Moreover, it avoids the unwanted interruption of having to mark a spot on the wall with some kind of pencil. Typically, that kind of marking scheme involves making a measurement, drawing a line with a pencil against the measuring instrument, and then making another mark to intersect the first line, thereby determining the location at which a nail ought to be installed.

The thickness of the ruler is sufficient that structural integrity and stiffness is maintained. The thickness can typically be about 1/16th of an inch, and can even be as much as 1/8th of an inch. Thicker rulers generally are not needed, and can be unwieldy when they become too thick. The width of the ruler typically approaches about 3/4 of an inch, up to about 1 inch, depending on specifics of the use. In this instance, one inch spacing is illustrated and is acceptable. Moreover, holes 42 serve as alignment holes so that nails are started straight and are at the desired spacing or location. The notches 44 can be used along one edge if desired. Generally, the notches are less desirable in that they do not provide comparable nail alignment at the time of placing nails to hang the framed items.

Going now to FIG. 4 of the drawings, the numeral 46 identifies one corner of a wall on which a first framed item 48 is hung. A second framed item 50 needs to be hung in relation to the first. The wall extends to the corner at 46 at one end and extends vertically to the ceiling line 52. Quite often, the orthogonal lines at 46 and 52 are assumed to be at right angles, but they may or may not be, and they also may be off by virtue of the framing of the structure and the wall finish applied to it. The wall may or may not be vertical, and the corner 46 may or may not be vertical. In any event, assume that a first framed item is installed at the location 48. The present apparatus is then used to position the framed item 50 at a determined relationship. The offset 54 derives from alignment errors attempted by hand without instruments. The lateral spacing 56 is also in FIG. 4, and should be a measured or calculated distance. It is desirable that the offset 54 be reduced to zero. One approach is to measure down from the ceiling 52, first to the framed item 48 and then to the framed item 50. Those measurements can be made equal. Those measurements, however, require that the installer position a steel measuring rule or tape against the ceiling and then make measurements downwardly to obtain the two vertical measurement and then hopefully bring the offset 54 to zero. The present apparatus makes this much easier. Measurements can be readily taken from the frame 48 to the frame 50. Such measurements alternately can be referenced from the nail used to hang the two frames 48 and 50. Assume that the nail under the frame is used as a reference point. The frame 48 is hung on a specifically located nail. Indeed, two nails can be used where the frame 48 is quite heavy. Whether one or two are used, they are used as a reference point. The present apparatus is positioned so that the ruler 30 extends along the wall and horizontally. Proper positioning is measured and tested by observation of the bubble levels in the device. Moreover the selected bubble level is observed continuously while positioning the ruler 30 in the housing so that it can then be extended to the side. If for instance the hanging nail for the frame 48 is used, that nail can be positioned at the end of the ruler and the ruler is then extended to locate and guide the second nail needed to hang the frame 50.

Consider another application; assume that both frames are to be placed on the wall with a precise spacing between the two. The ruler 30 is placed and leveled against the wall, and two separate nails are located relative to the wall and driven partly into the wall through the holes 42. The holes 42 properly align the nails so that they are driven at right angles into the wall. When partly driven as guided by the ruler, they can be used to make a starter hole, then the nails can be pulled by finger strength from the wall and the ruler then can be pulled away. Thereafter, the nails can be driven to an adequate depth using the starter holes which were aligned with the ruler. In an alternative approach, the notches 44 can be used to assure proper alignment. The notches therefore align two or more nails, and the nails can be driven home without having to move the ruler. If desired, headless hanger nails can be nailed without having to move the ruler. If desired, hanger nails with heads sufficiently small to pass through the openings 42 can be installed. In that case, the nails can be driven to an adequate depth without having to move the ruler.

Going back to FIG. 4, the offset 54 is avoided at the time of installation. Lateral spacing is accomplished by the distance 56 which is measured on the ruler 30. If desired, a second framed item can be hung under the first and is spaced therebelow by a vertical distance measured by the ruler. If desired, a first nail can be placed in the wall for the first frame 48 and second, third and additional hanging nails can be placed in the wall vertically offset from the first nail. As before, nailing can be done through the holes 42 in the ruler.

The method of use of the present disclosure contemplates lateral and vertical alignment of the frame 50 with respect to the frame 48. The offset 54 is reduced to zero while maintaining a level position determined by the bubble level 32, or 34, or both. This mode of hanging assures the desired lateral spacing 56 while avoiding difficulties of leveling and alignment. Consider the use of the present apparatus where spacing between the frames 48 and 50 is greater than the length of the ruler. In an instance, marks can be made with respect to the ruler at one end of the ruler or through one of the holes 42. Indeed, if a nail is placed for the frame 48, the ruler can be aligned with respect to it by aligning the nail through the hole 42 at some desired measure along the length of the ruler. Then, the ruler can be moved around the room. The ruler is rotated and leveled at each new position of the ruler. If desired a nail can be temporarily driven through one of the openings 42, typically at the remote end locations. Each step measured as the ruler is rotated carries the ruler further along the wall, but alignment is assured because the ruler is always leveled as proven by the bubble level.

FIG. 1 shows an optional cylindrical attached body 60 which is axially hollow and internally threaded to receive a thumb screw 64. The tip of the screw extends internally to the slot 24. The tip of the screw contacts against the edge of the ruler 30. If tightened, it can lock the ruler with respect to the housing. Equally, it can provide adjustable friction so that the ruler controllably slides or it does not slide at all. The body 60 can be omitted if desired.

While the foregoing is directed to the preferred embodiment, the scope can be determined from the claims which follow.

I claim:

1. An apparatus for alignment of a nail placed in a wall to assist in hanging first and second frames wherein the apparatus comprises:

(a) a housing having an alignment surface thereon;

(b) an extendible ruler slidably positioned against said alignment surface wherein said ruler has a measured length and said ruler incorporates first and second nail alignment surfaces fabricated within said ruler to enable nails to be guided by said nail alignment surfaces and thereby aligning said nails for nailing into the wall at a predetermined angle with respect to said wall;

(c) a first bubble level supported by said housing to assist in leveling with respect to a gravity defined reference for said first or second frames; and (d) a set of marked length calibrations along said ruler to thereby define spacing between said first and second frames referenced to said gravity defined reference, wherein said first and said second nail alignment surfaces are coincident with said marked length calibrations.

2. The apparatus of claim 1 wherein said housing includes a internal slot therein and said alignment surface is located within said slot, and further wherein said ruler extends through said slot so that said housing surrounds said ruler and moves therealong.

3. The apparatus of claim 1 wherein said housing supports a second bubble level at right angles to said first bubble level so that said housing can, on appropriate positioning, determine alignment with respect to a vertical or horizontal reference defined by said gravity reference.

4. The apparatus of claim 2 wherein said housing supports a second bubble level at right angles to said first bubble level so that said housing can, on appropriate positioning, determine alignment with respect to a vertical or horizontal reference defined by said gravity reference.

5. The apparatus of claim 1 wherein said housing comprises a rectangular housing having a pair of spaced end walls and said end walls incorporate slots there in aligned so that said ruler extends through said slots in said housing, and said ruler is positioned in said slots in contact with said alignment surface for telescoping movement with respect to said housing.

6. The apparatus of claim 1 wherein said housing includes a second bubble level aligned in parallel on said housing and parallel to said first bubble level so that said bubble levels provide level indications with said housing with respect to said gravity reference.

7. The apparatus of claim 6 wherein said housing supports a third bubble level at right angles to said first bubble level so that said housing can, on appropriate positioning, determine alignment with respect to a vertical or horizontal reference defined by said gravity reference.

8. The apparatus of claim 7 wherein said housing includes a internal slot therein and said alignment surface is located within said slot, and further wherein said ruler extends through said slot so that said housing surrounds said ruler and moves therealong.

9. The apparatus of claim 1 including a slot through said housing for securing said ruler therein and in contact with said alignment surface, and further including an adjustable threaded member movable to bear against said ruler to controllable clamp said ruler.

10. The apparatus of claim 9 wherein said nail alignment surfaces comprise holes in said ruler sized in diameter and depth to enable said holes to guide nails for straight nailing into said wall, wherein the position of nailing into said wall is defined with respect to a floating reference point.

11. A method hanging first and second frames comprising the steps of:

(a) positioning the first frame on a wall supported by a first nail;

(b) determining a horizontal reference with a ruler and a first bubble level with respect to said first nail and first frame;

(c) determining a vertical position with respect to said first nail and first frame using said ruler and a second bubble level;

(d) locating the position for a second frame from the horizontal and vertical references and second nail therefor; and (e) aligning said second nail with a nail alignment surface fabricated within said ruler so that said second nail is driven into said wall at a predetermined angle; and (f) wherein the step of determining vertical and horizontal references to position the second frame includes the step of extending said ruler to the specified distance between the first and second nails.

12. The method of claim 11 including the step of forming nail compatible surfaces at a continuum of measured locations along said ruler.

13. The method of claim 12 including the step of visually inspecting the first and second bubble levels on a housing supporting said ruler for sliding movement so that the first and second nails supporting the first and second frames are positioned by measurement with said ruler.

14. The method of claim 13 including the step of measuring between the first and second frames with said ruler to locate positions for said first and said second nails for said first and second frames.

15. The method of claim 14 including the measuring step of positioning the ruler on the wall and leveling the first bubble level simultaneously.

16. The method of claim 15 including the simultaneous step of positioning said first nail relative to said ruler to fix the ruler location.

17. The method of claim 16 including the step of positioning said second nail after the ruler is fixed in position so the second nail is located in relative position to the first nail.

* * * * *